US006540873B2

(12) United States Patent
Leandersson

(10) Patent No.: US 6,540,873 B2
(45) Date of Patent: Apr. 1, 2003

(54) BOARD MACHINE AND METHOD OF MANUFACTURING A MULTILAYER CARDBOARD WEB

(75) Inventor: Per Anders Artur Leandersson, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/083,077

(22) Filed: Feb. 26, 2002

(65) Prior Publication Data

US 2002/0129913 A1 Sep. 19, 2002

Related U.S. Application Data

(63) Continuation of application No. PCT/SE00/01647, filed on Aug. 28, 2000.
(60) Provisional application No. 60/159,281, filed on Oct. 13, 1999.

(51) Int. Cl.[7] ..... D21F 3/04; D21F 11/04
(52) U.S. Cl. ..... 162/132; 162/303; 162/360.2
(58) Field of Search ..... 162/125–133, 162/203–205, 298–301, 303, 304, 305, 306, 358.1, 358.3, 358.5, 359.1, 360.2, 360.3, 381

(56) References Cited

U.S. PATENT DOCUMENTS

| | | | | | |
|---|---|---|---|---|---|
| 4,197,158 A | | 4/1980 | Johnson | | |
| 4,483,745 A | * | 11/1984 | Wicks et al. | ..... | 162/205 |
| 4,957,778 A | | 9/1990 | Yrjälä | | |
| 4,961,824 A | | 10/1990 | Laitinen et al. | | |
| 5,074,964 A | | 12/1991 | Partanen | | |
| 5,080,758 A | * | 1/1992 | Horng | ..... | 162/130 |
| 5,639,349 A | | 6/1997 | Begemann et al. | | |
| 5,908,536 A | * | 6/1999 | Kaasalainen et al. | ..... | 162/205 |
| 5,935,382 A | | 8/1999 | Huovila et al. | | |

FOREIGN PATENT DOCUMENTS

| | | | | |
|---|---|---|---|---|
| EP | 0 233 058 A2 | | 8/1987 | |
| EP | 0 511 185 A1 | | 10/1992 | |
| EP | 0 511 186 A1 | | 10/1992 | |
| EP | 770727 A1 | * | 5/1997 | ..... D21F/3/04 |
| WO | WO 92/06242 | | 4/1992 | |
| WO | WO 99/60203 | * | 11/1999 | ..... D21F/3/00 |

* cited by examiner

*Primary Examiner*—Steven P. Griffin
*Assistant Examiner*—Eric Hug
(74) *Attorney, Agent, or Firm*—Alston & Bird LLP

(57) ABSTRACT

A board machine and method for making a multilayer cardboard web, in which a first layer of the web having a printable surface is formed in a first forming unit and carried on an extended forming wire thereof through a couching unit where the first layer is couched with one or more additional layers, the multilayer web then being carried on the extended wire to a pick-up point. An upper press felt of a double-felted press picks up the web at the pick-up point such that the printable surface faces downward and contacts the lower press felt through the nip of the press. The lower felt is smoother than the upper felt, and the lower felt contacts the lower press roll for a minimum sector angle beyond an exit of the nip to ensure that the web follows the lower felt.

18 Claims, 3 Drawing Sheets

BOARD MACHINE AND METHOD OF MANUFACTURING A MULTILAYER CARDBOARD WEB

CROSS-REFERENCE TO RELATED APPLICATIONS

This application is a continuation of International Application No. PCT/SE00/01647 filed Aug. 28, 2000, which designated the United States and was published in English under PCT Article 21, and which claims priority from provisional application Ser. No. 60/159,281, filed Oct. 13, 1999.

FIELD OF THE INVENTION

The present invention relates to a board machine and method for manufacturing a multilayer cardboard web with a printable surface layer, comprising a wet section and a press section, which wet section includes a first forming unit for forming a first layer, which first forming unit has at least one forming wire, running in an extended loop up to the press section to form a pick-up point for the multilayer cardboard web, and one or more further forming units for forming one or more further layers and for couching the same with said first layer on said extended forming wire of the first forming unit to form the multilayer cardboard web, which press section includes at least one double-felted press, having an upper press element, a lower press element in the shape of a press roll, which press elements create a press nip with each other, an upper press felt, running in a loop around a plurality of guide rolls and a pick-up roll, arranged at said pick-up point for transferring the multilayer cardboard web to the upper press felt, and a lower press felt, running in a loop around a plurality of guide rolls.

As used herein, the expression "the 0 line of the press" is defined, for a roll press, as the tangent perpendicular to a straight line intersecting the centers of the press rolls and, for a shoe press, as the tangent of the transition from the concave curvature to the convex curvature of the shoe at the exit of the press nip.

BACKGROUND OF THE INVENTION

One side of a multilayer cardboard web is often used for printing. This side, denoted the front side of the finished cardboard product, is formed by a surface layer that must have a high degree of surface smoothness to provide good printability. Special pulps are used for manufacturing the surface layer. Short-fiber pulps result in surface layers with improved printability. The pulp intended for the printable surface layer is preferably, but not necessarily, bleached. It may consist of a mixture of short-fiber and long-fiber pulps, in which the short-fiber proportion of the pulp may constitute 50–70 per cent by weight of the mass. However, the short-fiber proportion may constitute 100 per cent. The layer to be printed may also be made of 100 per cent bleached long-fiber pulp. Short-fiber pulp can be pulp from birch or eucalyptus, for instance, while long-fiber pulp can be pulp from pine, for instance.

A number of methods and machines for manufacturing multilayer cardboard webs are described in patent literature and the following are mentioned by way of example: EP-0 511 186, WO 92/06242, U.S. Pat. No. 4,961,824, EP-0 511 185, U.S. Pat. No. 5,074,964, EP-0 233 058 and SE-506 611.

U.S. Pat. No. 5,639,349 (corresponding to DE-4401761) describes a method for improving the quality of multilayer papers in the wet section of a paper machine by recirculating the drainage water within each forming unit. The outer layer of the paper web is made of stock of higher quality than the stock for the core. The patent specification does not mention cardboard or board and the problem associated with providing a printable surface layer on a multilayer cardboard web. Neither does the patent specification touch upon the problem relating to the press section and the web run in the same, and in particular does not address the problem of pressing of a multilayer cardboard web with a printable surface layer.

U.S. Pat. No. 4,957,778 describes a paper machine for manufacturing two-layer carbonless copy paper. The paper machine has upper and lower fourdrinier formers, the layers of which are combined by couching to form a coherent paper web, which is pressed in a press with two single-felted press nips, created by two press rolls and a counter roll shared by the same. Multilayer cardboard webs are not touched upon in this patent specification and, consequently, neither are the problems associated with pressing a multilayer cardboard web.

In practice, the predominant technique for manufacturing a multilayer cardboard web is to manufacture the surface layer with a forming unit, for instance an upper fourdrinier former, arranged relative to at least one other forming unit, for instance a lower fourdrinier former, in such a way that the surface layer is couched with a subjacent layer and the cardboard web emerges from the wet section with the surface layer facing upwards. This in turn dictates the configuration of the press section. In accordance with conventional techniques, a double-felted roll press is employed as the first press. It is also known to use a double-felted shoe press with the shoe in a top or bottom position as the first press. A first double-felted press of known kind has an upper felt acting as a pick-up felt to transfer the cardboard web to the press nip, while the lower felt is intended to carry the cardboard web subsequent to its passage through the press nip. The surface layer of the cardboard web thus comes into direct contact with the upper felt. Accordingly, to be able to satisfy the requirement of high surface smoothness of the surface layer, the structure of the web-contacting surface of the upper felt must not be too rough. If, on the other hand, the structure of the web-contacting surface of the lower felt were to be too smooth or fine to ensure the correct web run after the press nip, the lower felt will not be sufficiently open to allow permeation of water and will relatively quickly become clogged with fibers, which means that reconditioning of the lower felt cannot be accomplished with the desired result and that the service life of the lower felt becomes relatively short. In practice, the two contradictory requirements for the properties of the upper felt and the lower felt result in the requirement that the differences between their surfaces structures with respect to roughness or smoothness become relatively small and there is, therefore, a risk of the cardboard web sometimes having a tendency to accompany the upper felt after the press nip instead of the lower felt as intended, even if the lower felt has the smoother surface. To ensure the correct web run in a shoe press with the shoe in the bottom position the lower felt must be passed over the downstream edge of the shoe and the upper felt passed approximately in the direction of the so-called 0 line, but this is not an acceptable solution as the web is then subjected to detrimental shear forces during its passage over the shoe edge.

SUMMARY OF THE INVENTION

The object of the present invention is to provide an improved board machine and an improved method of manufacturing a multilayer cardboard web. The invention thus enables the manufacture of a multilayer cardboard web having a printable surface layer with a desired high degree of surface smoothness and maximum dry-solids content after the press section, while safeguarding the web run in the press section.

The board machine, in accordance with the invention, is characterized in that the first forming unit is arranged to form the printable surface layer and arranged with its extended forming wire to transfer the multilayer cardboard web to the upper press felt of the press with the printable surface layer facing downwards to contact the lower press felt in the press nip. The lower press felt has a finer web-contacting surface to exert a greater adhesion force on the multilayer cardboard web than the upper press felt, and the lower press felt at the discharge side of the nip is arranged to encompass the lower press roll by a predetermined minimum sector angle $\alpha$ measured from a point in the press nip intersected by the 0 line of the press, as defined herein for a roll press and a shoe press, respectively.

The method, in accordance with the invention, is characterized in that the printable surface layer is formed in the first forming unit and the extended forming wire transfers the multilayer cardboard web to the upper press felt of the press with the printable surface layer facing downwards so that it is in contact with the lower press felt in the press nip. The lower press felt exerts a greater adhesion force on the multilayer cardboard web than the upper press felt by virtue of its finer web-contacting surface, and the lower press felt is caused to encompass the lower press roll by a predetermined minimum sector angle $\alpha$ measured from a point in the press nip intersected by the 0 line of the press, as defined herein for a roll press and a shoe press, respectively.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
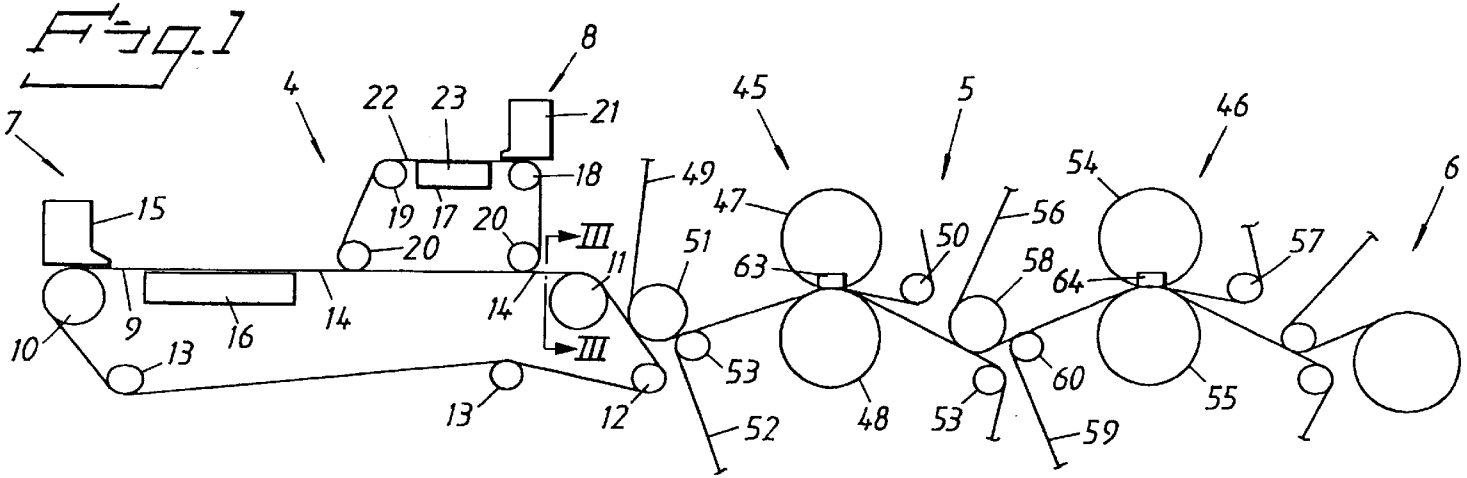
FIG. 1 shows schematically parts of a board machine for manufacturing a multilayer board web in accordance with a first embodiment of the invention.
Figure 2:
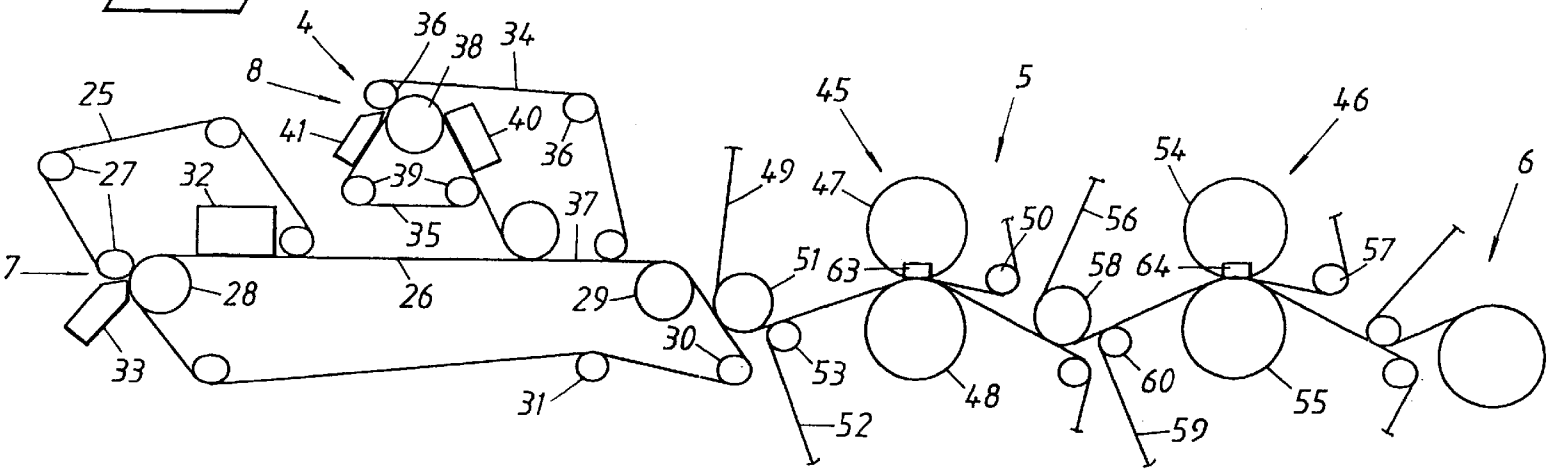
FIG. 2 shows schematically parts of a board machine for manufacturing a multilayer cardboard web in accordance with a second embodiment of the invention.

FIGS. 1 and 2 show schematically parts of a board machine for manufacturing a cardboard web 1, consisting of a first layer 2 and a further layer 3. In the embodiment shown and in accordance with the present invention, the first layer 2 forms a surface layer in the finished two-layer cardboard web, while the further layer 3 forms its core. Alternatively, a cardboard web is manufactured, consisting of said first layer and several further layers, one of which is said core.

The board machines comprise a wet section 4, a press section 5 and a drying section 6.

The wet section 4 comprises a first forming unit 7 for manufacturing the first layer 2 and a second forming unit 8 for manufacturing the second layer 3.

In the embodiment shown in FIG. 1, the two forming units 7, 8 consist of a first fourdrinier former, located upstream, and a second fourdrinier former, located downstream, while in the embodiment in accordance with FIG. 2, they consist of a first twin-wire former or gap former located upstream, and a second twin-wire former or gap former located downstream. In this context, the expressions "upstream" and "downstream" indicate the relative locations of the forming units viewed in the machine direction.

The first fourdrinier former 7, located upstream according to FIG. 1, is extended in the machine direction and has a fourdrinier wire 9, running in a loop around an upstream breast roll 10, a downstream suction couch 11, a wire turning roll 12 and a plurality of other types of guide rolls 13, such as alignment rolls and tension rolls. The upper part 14 of the fourdrinier wire 9, dewatering the stock and forming the layer and web, between the breast roll 10 and the suction couch 11 is plane and horizontal. The first fourdrinier former 7, located upstream, further comprises a headbox 15, arranged close to the breast roll 10 to emit a jet of stock onto the upper part 14 of the fourdrinier wire 9, and dewatering members 16 for dewatering the stock to form the first layer 2.

The second fourdrinier former 8, located downstream according to FIG. 1, has a fourdrinier wire 17, running in a loop around a breast roll 18, an upper guide roll 19 and two lower guide rolls 20, which lower guide rolls are arranged in close proximity to the upper part 14 of the fourdrinier wire 9 of the first fourdrinier former 7 for couching the formed second layer with the formed first layer. The second fourdrinier former 8 comprises a headbox 21, arranged close to the breast roll 18 to emit a jet of stock onto the upper, plane part 22 of the fourdrinier wire 17, and dewatering members 23 for dewatering the stock to form the second layer.

The first twin wire former, located upstream according to FIG. 2, has first and second forming wires 25, 26, which run together in a forming zone. The first forming wire 25 runs in an upper loop around a plurality of guide rolls 27. The second forming wire 26 runs in a lower loop around an upstream forming roll 28 and a downstream suction couch 29, a wire turning roll 30 and a plurality of other guide rolls 31, comprising alignment rolls and tension rolls. The lower forming wire 26 is extended up to the press section so that the suction couch 29 is located downstream of the second twin wire former 8. In the loop of the first forming wire 25, dewatering means 32 are arranged within said forming zone. A headbox 33 is arranged to emit a jet of stock into a gap defined by the forming roll 28 and a guide roll 27 located adjacently to the same in the upper wire loop 25.

The second twin wire former 8, located downstream according to FIG. 2, has first and second forming wires 34, 35, which run together in a forming zone. The first forming wire 34 runs in a loop around a plurality of guide rolls 36 and has a lower, linear part 37, passing along the lower forming wire 26 of the first twin wire former 7 to create a couching zone. The second forming wire 35 runs in a loop around a forming roll 38 and, two guide rolls 39. In the loop of the first forming wire 34, dewatering means 40 are arranged within said forming zone. A headbox 41 is arranged to emit a jet of stock into a gap defined by the forming roll 38 and a guide roll 36 located adjacently to the same in the first wire loop 34.

Figure 3:
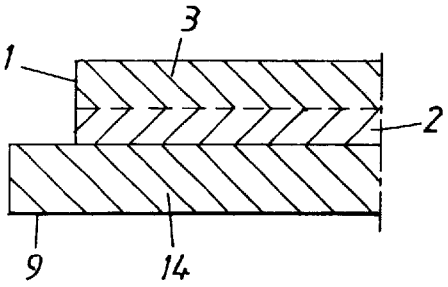
FIG. 3 is a cross section along the line III—III in FIG. 1.

The first forming unit 7, located upstream, is arranged to create a surface layer 2 suitable for printing in the finished cardboard web, while the second forming unit 8, located downstream, is arranged to create a core 3, which encounters the surface layer so that the two layers are couched together with each other to a coherent two-layer cardboard web, see FIG. 3, which leaves the forming wire 9, 26 of the first forming unit 7 with the surface layer facing downwards.

The press section 5 in the board machines shown in FIGS. 1 and 2 comprises a first double-felted press 45 and a second double-felted press 46, which presses 45, 46 are arranged directly one after the other. The first press 45 comprises an upper press element 47 and a lower press element 48, which press elements create a press nip with each other. The first press 45 further comprises an upper press felt 49, which runs in a loop around a plurality of guide rolls 50, comprising a pick-up suction roll 51 for transferring the multilayer cardboard web 1 to the upper press felt 49, and a lower press felt 52, which runs in a loop around a plurality of guide rolls 53, and which together run through the press nip with the web 1 enclosed therebetween in a sandwich construction. The second press 46 comprises an upper press element 54 and a lower press element 55, which press elements create a press nip with each other. The second press 46 further comprises an upper press felt 56, which runs in a loop around a plurality of guide rolls 57, comprising a pick-up suction roll 58 for transferring the multilayer cardboard web 1 to the upper press felt 56, and a lower press felt 59, which runs in a loop around a plurality of guide rolls 60, and which together run through the press nip with the web 1 enclosed therebetween in a sandwich construction.

The lower press felt 52, 59 of each press 45, 46 has a finer surface structure than the upper press felt 49, 56 with the purpose of ensuring that the web 1 adheres to the lower press felt 52, 59 and not to the upper press felt 49, 56 after the press nip. This difference in surface structure or adhesive capability is a first parameter to assist in safeguarding the correct web run.

The lower press element 48, 55 in each press is a press roll, around which the lower press felt 52, 59 runs in contact with the envelope surface of the press roll after the press nip by a pre-determined minimum sector angle $\alpha$ measured from a certain point in the press, depending on which type of press is used, as explained below. The web has a tendency to accompany the one of the two press felts that has the greater part in contact with the press roll after the press nip. This circumstance is a second parameter to assist in safeguarding the correct web run. At least the first parameter, and preferably both the first and second parameters, are utilized in the press, while the printable surface layer 2 simultaneously faces downwards. This enables an increased difference between the degrees of surface smoothness of the lower and upper felts. At the same time, the lower press felt is caused to maintain contact with the lower press roll downstream of the nip for a predetermined sector angle. Thus, the proper web run is facilitated.

Figure 4:
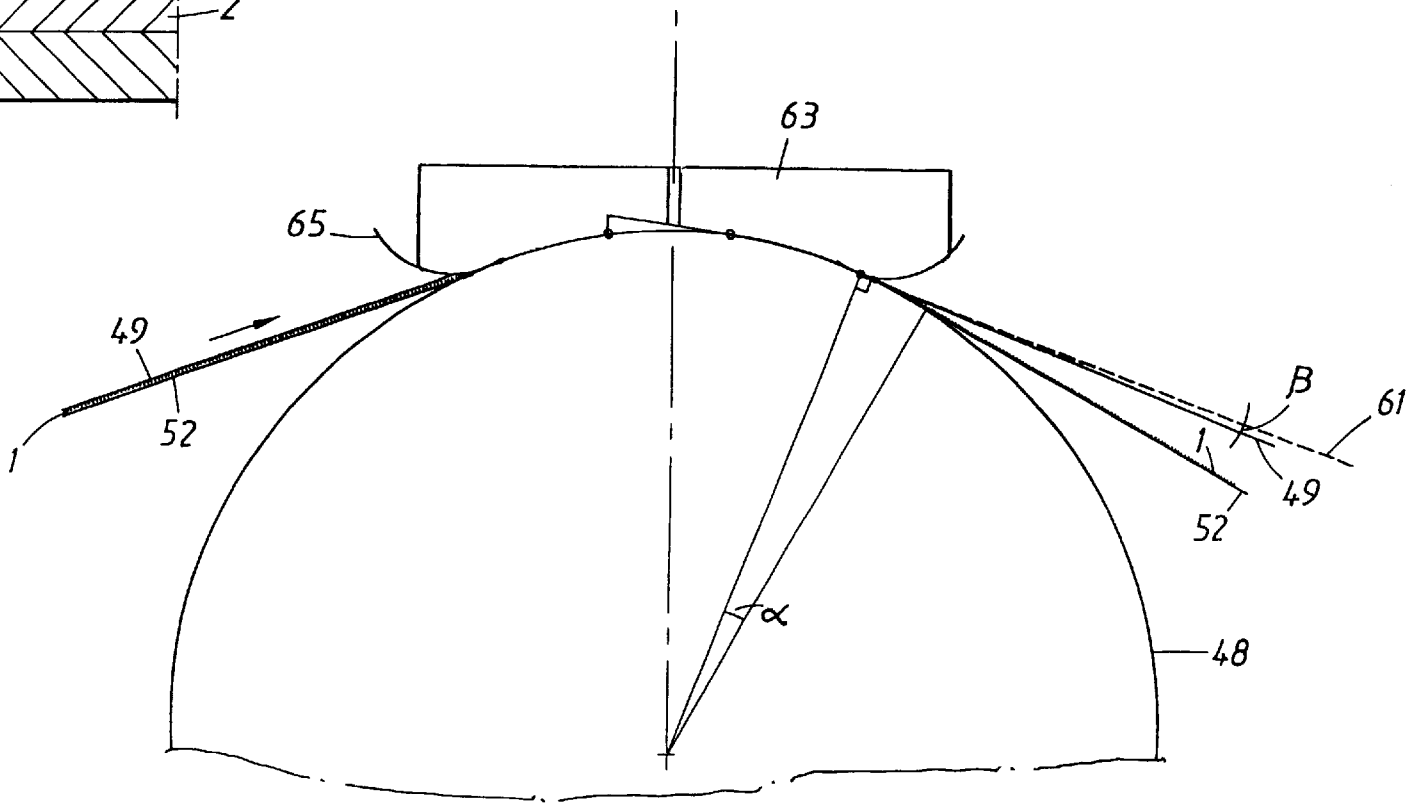
FIG. 4 shows schematically a part of a shoe press used in the board machines shown in FIGS. 1 and 2.

The press sections 5 shown in FIGS. 1 and 2 are alike and their presses consist of a first shoe press 45 with a press shoe 63 and a subsequent, second shoe press 46 with a press shoe 64. Each shoe press 45 has a shoe roll 47, 54 in the upper position and a counter roll 48, 55 in the lower position. Each counter roll 48, 55 can have a blind-drilled, grooved or smooth envelope surface. Each shoe roll or one of the shoe rolls has an envelope surface 65, see FIG. 4, in the shape of a press belt that is smooth, blind-drilled or grooved. From the point of view of operability, a blind-drilled or grooved press belt 65 is preferable, as this provides a large open volume behind the upper press felt 49, 56 so that the cardboard web acquires a high dry-solids content while the upper press felt simultaneously remains open towards the open surface behind the upper press felt to enable ventilation of the same. Such high dry-solids content is further improved by employing a blind-drilled or grooved counter roll, thus providing a large open volume behind the lower press felt 52, 59. In especially difficult operating conditions, such as high web speed and low surface weight, a counter roll with a smooth envelope surface is used because the large open volume is not required, as smaller quantities of water (low surface weight) need to be removed and an extra great vacuum pulse is created in the lower press felt, which results in the "attraction" of the web to the lower felt being increased still further. Placing the shoe rolls in a top position creates enhanced possibilities for guiding the cardboard web to the lower press felt by arranging the lower felt to encompass the counter roll to a greater extent.

The lower press felt 52 is arranged to encompass the counter roll 48 with a pre-determined minimum sector angle $\alpha$ of 10° measured from a point (denoted a 0 point herein) on the periphery of the shoe 63 at which the concave curvature of the shoe transitions into a convex curvature, the tangent of this point being denoted the 0 line 61 of the shoe. The part of the upper press felt 49 surrounding the counter roll 48 is adjustable within a range from +5° to −5° measured as an angle $\beta$ between the upper press felt 49 and the 0 line 61, positive angle values being located below and negative angle values above this 0 line 61.

Figure 5:
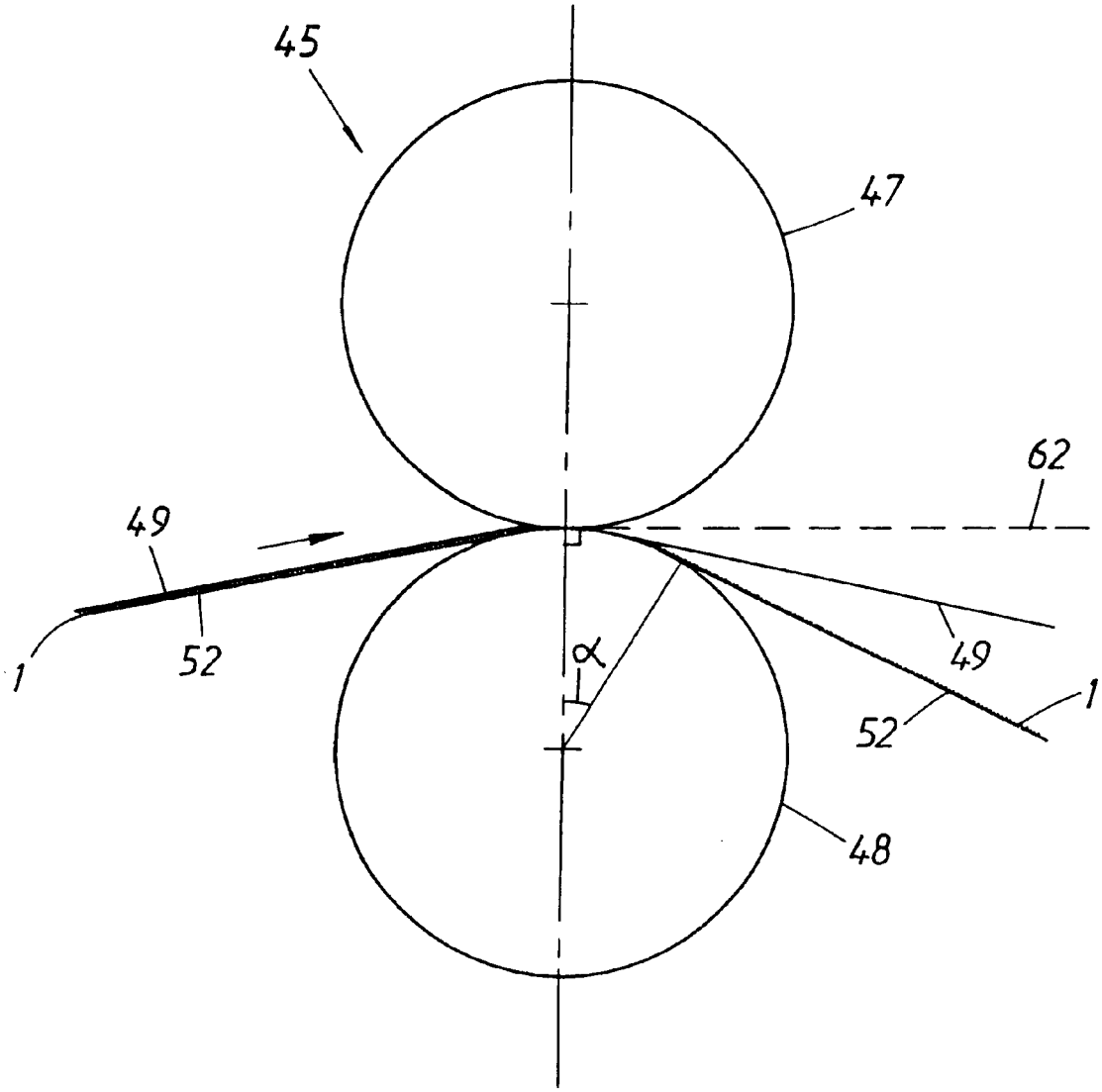
FIG. 5 shows schematically a roll press in a board machine for manufacturing a multilayer cardboard web in accordance with a third embodiment of the invention.

Alternatively, the first press 45 can consist of a roll press as shown in FIG. 5. The second press 46 in such a press section can be a similar roll press or a shoe press as described above. The upper and lower press rolls 47, 48 of the roll press can have smooth, blind-drilled or grooved envelope surfaces. The lower press felt 52, see FIG. 5, is arranged to encompass the lower press roll 48 by a pre-determined minimum sector angle $\alpha$ of 10° measured from a 0 point on the periphery of the lower press roll 48 that is tangent to the periphery of the upper press roll. Stated differently, the 0 point is located on the periphery of the lower press roll 48 at a point intersected by a straight line connecting the centers of the press rolls 48, 47. The tangent to this 0 point is perpendicular to the straight line intersecting the centers of the press rolls, which tangent is denoted as the 0 line 62 of the roll press. The sector angle $\alpha$ is normally in the range 10°–25° for a roll press. The part of the upper press felt 49 surrounding the lower press roll 48 is adjustable within a range from +10° to −5° measured as an angle $\beta$ between the upper press felt 49 and the 0 line 62, positive angle values being located below and negative angle values above this 0 line 62.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims.

Although specific terms are employed herein, they are used in a generic and descriptive sense only and not for purposes of limitation.

What is claimed is:

1. A board machine for making a multilayer cardboard web with a printable surface, comprising:

a wet section comprising a first forming unit for forming a first board layer on a forming wire, and at least one additional forming unit for forming at least one additional board layer and couching the first board layer with the additional board layer(s) to form the multilayer cardboard web; and a press section comprising at least a first double-felted press that receives the multilayer web from the forming section, the first double-felted press being formed by an upper press member and a lower press member forming a nip therebetween, the lower press member comprising a press roll and being disposed within a loop of a lower press felt, the upper press member being disposed within a loop of an upper press felt, the upper and lower press felts passing through the nip with the multilayer web sandwiched therebetween;

wherein the forming and press sections are structured and arranged such that the printable surface is formed on the first board layer and the forming wire of the first forming unit carries the multilayer web up to the double-felted press, the upper press felt picks up the multilayer web from the forming wire such that the printable surface faces downward and contacts the lower press felt as the multilayer web passes through the nip, and the lower press felt has a smoother web-contacting surface than that of the upper press felt so as to exert a greater adhesion force on the multilayer web.

2. The board machine of claim 1, wherein the upper press member includes a shoe defining a surface that faces the press roll, and at a discharge side of the nip the lower press felt remains in contact with the press roll for a sector angle $\alpha$ of at least 10° beyond a 0 point at which the surface of the shoe transitions from a concave to a convex curvature.

3. The board machine of claim 2, wherein the upper press felt departs the nip at an angle $\beta$ relative to a 0 line that is tangent to the shoe at said 0 point, the angle $\beta$ being about −5° to +5°.

4. The board machine of claim 2, wherein the upper press member comprises a shoe roll including said shoe.

5. The board machine of claim 1, wherein the upper press member comprises a press roll having an outer surface that is tangent to the lower press member at a 0 point, and at a discharge side of the nip the lower press felt remains in contact with the lower press roll for a sector angle $\alpha$ of at least 10° beyond the 0 point.

6. The board machine of claim 5, wherein the upper press felt departs the nip at an angle $\beta$ relative to a 0 line that is tangent to the lower press roll at said 0 point, the angle $\beta$ being about −5° to +10°.

7. The board machine of claim 1, wherein the press section includes a second double-felted press.

8. The board machine of claim 7, wherein each double-felted press comprises a shoe press in which the upper press member includes a press shoe.

9. The board machine of claim 8, wherein each upper press member comprises a shoe roll.

10. The board machine of claim 7, wherein the second double-felted press is arranged such that the upper press felt thereof picks the multilayer web up from the lower press felt of the first double-felted press.

11. The board machine of claim 8, wherein each double-felted press comprises a roll press in which the upper press member comprises a press roll.

12. A method for manufacturing a multilayer cardboard web with a printable surface, comprising:

forming a first board layer in a first forming unit such that the first board layer has said printable surface;

forming at least one additional board layer in at least one additional forming unit;

couching the first board layer and said at least one additional board layer together to form a multilayer cardboard web having said printable surface;

transferring the multilayer cardboard web onto a lower press felt of a first double-felted press with said printable surface in contact with a surface of the lower press felt, wherein the first double-felted press comprises an upper press member disposed within a loop formed by an upper press felt and a lower press member disposed within a loop formed by the lower press felt; and passing the multilayer cardboard web through a nip of the first double-felted press sandwiched between the lower press felt and the upper press felt;

wherein the surface of the lower press felt in contact with the printable surface of the multilayer cardboard web is smoother than a web-contacting surface of the upper press felt in contact with an opposite surface of the web so as to cause the web to remain adhered to the lower press felt as the press felts diverge downstream of the nip.

13. The method of claim 12, wherein the upper press member includes a shoe and the lower press member comprises a press roll, the shoe defining a surface that forms an extended nip with the press roll, and wherein at a discharge side of the nip the lower press felt remains in contact with the press roll for a sector angle $\alpha$ of at least 10° beyond a 0 point at which the surface of the shoe transitions from a concave to a convex curvature.

14. The method of claim 13, wherein the upper press felt departs the nip at an angle $\beta$ relative to a 0 line that is tangent to the shoe at said 0 point, the angle $\beta$ being about −5° to +5°.

15. The method of claim 12, wherein the upper press member comprises a press roll having an outer surface that is tangent to the lower press member at a 0 point, and at a discharge side of the nip the lower press felt remains in contact with the lower press roll for a sector angle $\alpha$ of at least 10° beyond the 0 point.

16. The method of claim 15, wherein the upper press felt departs the nip at an angle $\beta$ relative to a 0 line that is tangent to the lower press roll at said 0 point, the angle $\beta$ being about −5° to +10°.

17. The method of claim 12, wherein the multilayer cardboard web is dewatered by passing the web through the first double-felted press and then through a second double-felted press, the upper press felt of each press receiving the web upstream of the nip.

18. The method of claim 17, wherein the upper press felt of the first double-felted press picks the multilayer cardboard web up from an extended forming wire of the first forming unit, and the upper press felt of the second double-felted press picks the web up from the lower press felt of the first double-felted press after the web has passed through the first double-felted press.

* * * * *